US006672429B1

(12) United States Patent
Thurmond, III

(10) Patent No.: US 6,672,429 B1
(45) Date of Patent: Jan. 6, 2004

(54) ENCODING SYSTEM FOR COMMUNICATING WITH ELEVATOR I/O DEVICES

(75) Inventor: Charlie R. Thurmond, III, Olive Branch, MS (US)

(73) Assignee: Thyssen Elevator Capital Corp., Whittier, CA (US)

( * ) Notice: Subject to any disclaimer, the term of this patent is extended or adjusted under 35 U.S.C. 154(b) by 0 days.

(21) Appl. No.: 09/523,186

(22) Filed: Mar. 10, 2000

(51) Int. Cl.[7] ..... B66B 1/28
(52) U.S. Cl. ..... 187/247; 187/391
(58) Field of Search ..... 187/247, 248, 187/351, 393; 340/310.01, 10.31, 10.32, 7.43, 7.45, 7.47

(56) References Cited

U.S. PATENT DOCUMENTS 4,860,207 A * 8/1989 Kubo ..... 187/247
5,360,952 A * 11/1994 Brajczewski et al. ..... 187/248
5,513,324 A 4/1996 Dolin, Jr. et al. ..... 395/200.18
5,654,531 A * 8/1997 Farabee et al. ..... 187/247
6,349,795 B1 * 2/2002 Tatsumi et al. ..... 187/247
6,471,011 B1 * 10/2002 Ando et al. ..... 187/247
6,497,306 B2 * 12/2002 Mori et al. ..... 187/391

* cited by examiner

*Primary Examiner*—Jonathan Salata
(74) *Attorney, Agent, or Firm*—White & Case LLP

(57) ABSTRACT

An elevator system has a control processor which communicates with numerous I/O devices over a serial communications link. The processor is programmed to generate and receive data packets containing a 2-byte I/O identification field. The first byte is a general category representing the type of function performed by the I/O device, and the second byte represents the identity of the particular I/O device within its general category. The I/O devices similarly generate and receive data packets containing the 2-byte I/O identification field. By way of example, categories may represent such functions as car call inputs, car call outputs, code blue inputs, code blue outputs, fire service, and so on. For a category such as car call inputs, the car call button for each floor would be assigned a separate sub-category designation. The invention provides an efficient transmission of large numbers of data packets containing small amounts of date, reduces the amount of memory required by the distributed electronics and limits the amount of bandwidth used in identifying each I/O device on the serial link.

3 Claims, 2 Drawing Sheets

I/O IDENTIFICATION CHART

| GROUP | SUB-GROUP | I/O DEVICE |
|---|---|---|
| 00 | 00 | none |
| 01 | 01 | door close |
| | 02 | door close button-front |
| | 03 | door close button-rear |
| | 04 | door close limit |
| | ... | |
| | FF | door disable |
| 02 | 01 | code blue call-input |
| | 02 | |
| 03 | 01 | code blue call-output |
| | 02 | |
| 04 | 01 | car call output 1 |
| | 02 | car call output 2 |
| | ... | |
| | FF | car call output 255 |
| 05 | 01 | car call-rear-output 1 |
| | 02 | car call-rear-output 2 |
| | ... | |
| | FF | car call-rear-output 255 |
| 06 | 01 | car call input 1 |
| | 02 | car call input 2 |
| | ... | |
| | FF | car call input 255 |
| 07 | 01 | car call input-rear 1 |
| | 02 | car call input-rear 2 |
| | ... | |
| | FF | car call input-rear 255 |
| 08 | 01 | fire service indicator 1 |
| | 02 | fire service indicator 2 |
| | 03 | fire service sensor 1 |
| | 04 | fire service sensor 2 |
| | ... | |
| | FF | fire sensor sensor 253 |
| 09 | 01 | car call lockout |
| | 02 | |
| | ... | |
| 0A | 01 | car call lockout-rear |
| | 02 | |
| | ... | |
| | FF | |
| 0B | 01 | speed #1 |
| | 02 | speed #2 |
| | 03 | speed leveling |
| 0C | 01 | hall lantern-landing sig. |
| 0D | 01 | hall call up-output |
| | 02 | |
| | ... | |
| | FF | |
| 0E | 01 | hall call up-input |
| | 02 | |
| | ... | |
| | FF | |

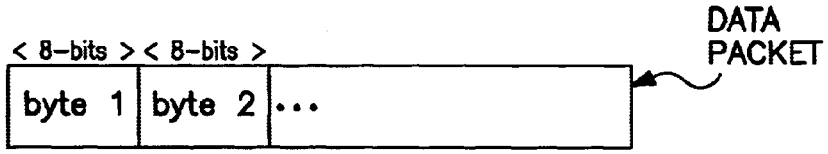

I/O IDENTIFICATION CHART

| GROUP | SUB-GROUP | I/O DEVICE |
|---|---|---|
| 00 | 00 | none |
| 01 | 01 | door close |
| | 02 | door close button–front |
| | 03 | door close button–rear |
| | 04 | door close limit |
| | ... | |
| | FF | door disable |
| 02 | 01 | code blue call–input |
| | 02 | |
| 03 | 01 | code blue call–output |
| | 02 | |
| 04 | 01 | car call output 1 |
| | 02 | car call output 2 |
| | ... | |
| | FF | car call output 255 |
| 05 | 01 | car call–rear–output 1 |
| | 02 | car call–rear–output 2 |
| | ... | |
| | FF | car call–rear–output 255 |
| 06 | 01 | car call input 1 |
| | 02 | car call input 2 |
| | ... | |
| | FF | car call input 255 |
| 07 | 01 | car call input–rear 1 |
| | 02 | car call input–rear 2 |
| | ... | |
| | FF | car call input–rear 255 |
| 08 | 01 | fire service indicator 1 |
| | 02 | fire service indicator 2 |
| | 03 | fire service sensor 1 |
| | 04 | fire service sensor 2 |
| | ... | |
| | FF | fire sensor sensor 253 |
| 09 | 01 | car call lockout |
| | 02 | |
| | ... | |
| 0A | 01 | car call lockout–rear |
| | 02 | |
| | ... | |
| | FF | |
| 0B | 01 | speed #1 |
| | 02 | speed #2 |
| | 03 | speed leveling |
| 0C | 01 | hall lantern–landing sig. |
| 0D | 01 | hall call up–output |
| | 02 | |
| | ... | |
| | FF | |
| 0E | 01 | hall call up–input |
| | 02 | |
| | ... | |
| | FF | |

FIG. 2

ENCODING SYSTEM FOR COMMUNICATING WITH ELEVATOR I/O DEVICES

STATEMENT REGARDING FEDERALLY FUNDED RESEARCH OR DEVELOPMENT

Not Applicable.

BACKGROUND OF THE INVENTION

1. Field of the Invention

The present invention relates generally to systems used in elevators for encoding the identity of various input/output ("I/O") devices. In particular, the present invention concerns systems and methods for reducing the memory and bandwidth requirements of an electronic elevator system by uniquely identifying various elevator I/O devices with a 2-byte identification field.

2. Description of the Related Art

An elevator includes a car for moving passengers or freight between various landings, or floors, using various drive systems such as a traction drive system or a hydraulic system. The movement of the car is controlled by a controller comprising one or more computers, which must communicate with various I/O devices. Devices in the elevator system are generally located in three places: a machine/power-unit room; the car; and a hallway near the landings. In addition to the controller for the drive system, the devices include the floor selection buttons inside the car, the hall call buttons, the hall and car lanterns, the drive motor for opening and closing the car door, a selector for determining certain parameters such as the car location, speed and direction, various sensors, and the safety equipment of the elevator.

Traditionally I/O devices were connected to the controller through discrete wiring. A separate wire was needed to connect each I/O device to the controller. Thus, if the controller were located in a swing return, all I/O devices from the hall and power-unit room needed to be connected via a traveling cable. In order to reduce the number of discrete wires running from the hall and the car to the controller, some elevator manufacturers began using a distributed I/O system.

In a distributed I/O system, there must be a common protocol for communicating between intelligent I/O devices and the controller. Various communications protocols have been developed to allow a computer to communicate with multiple I/O devices over a serial link. Because the I/O devices are linked serially, any protocol used with the system must provide a means for identifying the sending and receiving I/O device, as well as a means for sending data and messages. One well-known protocol that has been used in elevator equipment is LonTalk.®

The LonTalk® protocol, which is described in U.S. Pat. No. 5,513,324 to Dollin, Jr. et al., the disclosure of which is hereby incorporated by reference, provides a framework for communicating between intelligent I/O devices and the controller. In some areas, this framework is completely defined, while in other areas some flexibility is provided. LonTalk® uses Standard Network Variable Types ("SNVTs") to allow many types of information to be sent. Unfortunately, there are no SNVTs available that are suitable for identifying standard elevator I/O devices. Therefore, elevator manufacturers using LonTalk® have had to develop their own network variables. Present systems use an ASCII encoding system to identify various I/O devices. In such elevator systems, each I/O device is identified by a mnemonic. For example, Fire Service Call Cancel is identified by the mnemonic "FSCC".

One problem with present systems that use ASCII encoding is that each letter of the mnemonic takes a byte of data. Because the operation of elevators involves sending large numbers of data packets, it would be desirable to provide a more efficient way of identifying I/O devices. It is thus an object of the present invention to reduce the number of bytes necessary to identify uniquely each I/O device within the elevator system. This would help minimize the length of the messages being sent between devices, and consequently speed up communications and reduce the systems memory requirements.

BRIEF SUMMARY OF THE INVENTION

An elevator system according to the invention has a control processor that communicates with numerous I/O devices over a serial communications link. The processor is programmed to generate and receive data packets containing a 2-byte I/O identification field. The first byte is a general category representing the type of function performed by the I/O device, and the second byte represents the identity of the particular I/O device within such group. The I/O devices similarly generate and receive data packets containing the 2-byte I/O identification field. By way of example, categories may represent such functions as car call inputs, car call outputs, code blue inputs, code blue outputs, fire service, and so on. For a category such as car call inputs, the car call button for each floor would be assigned a separate subcategory designation. The invention reduces the amount of memory required by the distributed electronics and limits the amount of bandwidth used in identifying each I/O device on the serial link.

For a better understanding of the invention, reference is made to the following detailed description of a preferred embodiment, taken in conjunction with the drawings accompanying the application.

BRIEF DESCRIPTION OF THE SEVERAL VIEWS OF THE DRAWING

FIG. 2 is a Table illustrating the assignment of identifications to some of the I/O devices used in a typical elevator.

DETAILED DESCRIPTION OF THE INVENTION

Figure 1:
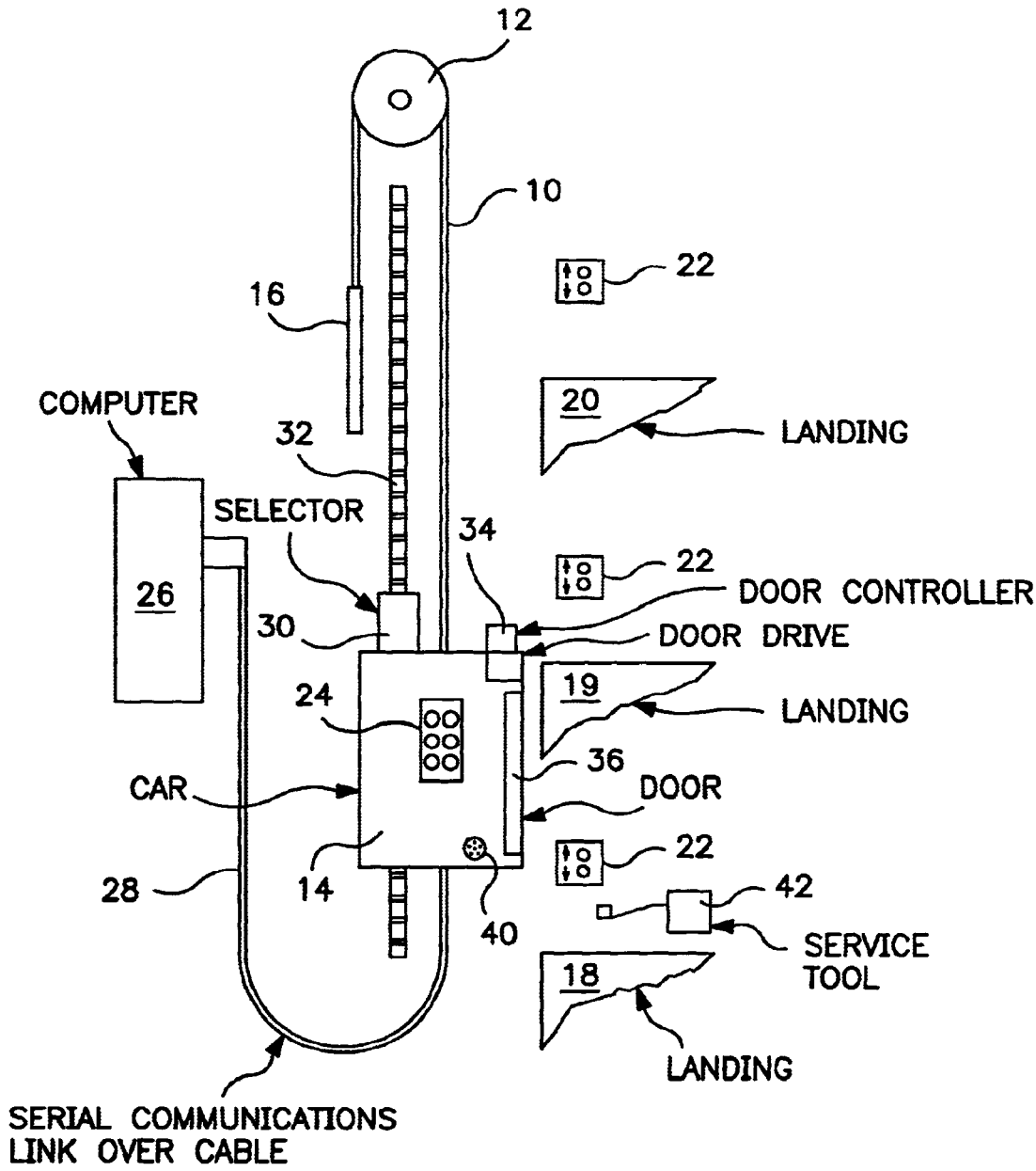
FIG. 1 is a schematic view of an elevator system.

FIG. 1 illustrates schematically a traction elevator having a rope 10 entrained over a drive sheave 12 and suspending, at its opposite ends, a car 14 and a counterweight 16, respectively. The car 14 is moveable between a plurality of landings 18, 19, and 20 by a motor drive system (not shown) which rotates the drive sheave 12.

In order to control the movement of the car 14, hall call buttons 22 are provided at each landing 18, 19, 20, and car call buttons 24 are provided inside the car 14. A computer 26 communicates with the hall call buttons by way of fixed wiring, and communicates with the car call buttons 24 by way of a traveling cable 28. A selector 30 mounted on the car 14 senses the position, speed, and direction of the car, and also communicates with the computer 26 by way of the traveling cable 28. The selector typically includes sensor elements which can read position indicators 32 mounted in the elevator hoistway. Finally, a door controller 34 is provided to control the opening and closing of the door 36.

In addition to the hall and car call buttons and the selector, there are numerous other I/O devices which communicate with the computer 26. These include devices to actuate the up and down hall lanterns on each floor, the floor indicators inside the elevator car, the alarm bell, code blue overrides, emergency shutoff, fire service, inspection mode, re-leveling at floors, and the opening and closing of the doors. Such devices also control the speed and direction of the motor drive, when the elevator is in operation. Moreover, the elevator includes numerous sensors to detect the elevator state. These include sensors to detect the speed, direction, and position of the car, as mentioned above, as well as sensors to monitor various conditions such as the presence of persons or objects preventing door closing, and various safety devices. The elevator also typically includes devices to control and monitor the opening and closing of the doors and the operation of the door motors. In the case of hydraulic elevators, sensors are provided to monitor various parameters relating to the hydraulic motor and pump.

In a preferred embodiment all of these I/O devices are intelligent devices and communicate with the computer 26 either over fixed wiring or, if mounted in or on the car, over the traveling cable 28. The computer 26 uses the information from the sensors and other devices to control the opening and closing of the doors, to control the operation of the motor drive system to move the car between floors, to stop the car at the desired floor, and to perform certain other functions such as the lights, air conditioning, and security.

The I/O devices communicate with the host computer 26 over a serial communications line. Because the elevator system uses serial communications, it is necessary to have a common communication protocol. In a preferred embodiment, the elevator system would comprise a LonWorks® network. LonWorks® is technology developed by Echelon Corporation and is commercially available. In a LonWorks® network, intelligent I/O devices, called nodes, communicate with each other using a common protocol called LonTalk.® Each node in the network contains embedded intelligence that implements the protocol and performs control functions. In addition, each node includes a physical interface that couples the node with the communication medium.

Moreover, because serial communication is used, it is necessary to assign a unique address to each item within the network. Thus, when the computer receives a data packet, it can determine the source of such information. And similarly, when the computer issues a command over the serial link, the I/O device for whom such data is intended can recognize such data packet and process the information.

In accordance with the present invention, each I/O device is assigned a 2-byte identification. The first byte represents the general category of the function performed by the device. The second byte represents its identification within that group. By way of example, all fire service related I/O may be grouped in one category or group, and code blue I/O may all be grouped in another category or group. Each I/O device performing a fire service function would be grouped within the fire service category and assigned an individual sub-group identity. Because each group and sub-group field contains a byte of information, it is possible to assign up to 256 groups by category and to group up to 256 I/O devices in each category.

Examples of logical categories for some elevator I/O devices are given in the table of FIG. 2. FIG. 2 does not purport to list all the I/O devices used in known elevators, but rather is meant to illustrate how I/O devices are categorized and sub-categorized. When designing an actual elevator, the remaining I/O devices would similarly be separated by category, and the devices within each category would be assigned a sub-category designation.

In addition to communications between the I/O devices and computer 26 during normal elevator operation, when the elevator is serviced, it is desirable to allow a service tool to communicate with various I/O devices. In order to do so, typically elevators provide one or more inputs 40 so that the servicing tool 42 can tie into the serial link and monitor and issue commands over such link. In the case of the present invention, the service tool 42, as does the computer 26, contains programming to decode data packets to extract the 2-byte identification of the I/O device, and to generate data packets for transmission to the I/O devices containing the 2-byte identification of the intended I/O device in the appropriate data field or block.

The encoding system of the present invention allows small amounts of data to be sent fast, which is important when operating an elevator system. It also minimizes the amount of memory and bandwidth needed to store and communicate data, which again are important considerations in the operation of an elevator.

The foregoing represents a preferred embodiment of the invention. Variations and modifications will be apparent to persons skilled in the art, without departing from the inventive concepts disclosed herein. Thus, while examples of elevator drives, i.e., traction and hydraulic drives, have been given, the invention may be employed with any suitable apparatus for raising and lowering the position of the car between floors. All such modifications and variations are intended to be within the skill of the art, as defined in the following claims.

What is claimed is:

1. In an elevator system having a car with a door, a plurality of landings, means for moving said car between landings, a door drive for selectively opening and closing said door, a control processor for controlling at least some of the operations of said elevator system responsive to I/O data, wherein said control processor is programmed with a communications protocol to generate and receive data packets containing an I/O identification field, and a plurality of I/O devices communicating over a serial data communication line with said control processor and having means to generate and receive data packets containing said I/O identification field, the improvement wherein each I/O device is assigned a 2-byte identification in which the first byte a general category representing the type of function performed by the I/O device, and the second byte of the said device within its general category, and wherein said control processor and I/O devices are programmed to generate data packets, and to recognize data packets, containing the said 2-byte identification in said identification field.

2. A process for communicating between a computer and a plurality of I/O devices in an elevator system, comprising the steps of:

(a) assigning each I/O device a 2-byte identification in which the first byte a general category representing the type of function performed by the I/O device, and the second byte identifies the I/O device within category;

(b) generating data packets in said computer, each having a 2-byte field containing the identification of a particular I/O device;

(c) sending said data packets over a serial communications link to all of said I/O devices;

(d) generating data packets in said I/O devices, each having a 2-byte field containing the identification of said device; and (e) sending said data packets over said serial communications link to said computer.

3. A process for servicing an elevator system having a plurality of I/O devices, using a servicing tool, comprising the steps of:

(a) assigning each I/O device a 2-byte identification in which the first byte a general category representing the type of function performed by the I/O device, and the second byte identifies the I/O device within category;

(b) generating data packets with said servicing tool, each having a 2-byte field containing the identification of a particular I/O device;

(c) sending said data packets over a serial communications link to all of said I/O devices;

(d) generating data packets in said I/O devices, each having a 2-byte field containing the identification of said device; and (e) sending said data packets over said serial communications link to said servicing tool.

* * * * *

UNITED STATES PATENT AND TRADEMARK OFFICE

CERTIFICATE OF CORRECTION

PATENT NO. : 6,672,429 B1
DATED : January 6, 2004
INVENTOR(S) : Charlie R. Thurmond, III It is certified that error appears in the above-identified patent and that said Letters Patent is hereby corrected as shown below:

Column 5,
Lines 1 and 13, insert -- identifies -- after "first byte".
Line 3, delete "of" and substitute therefor -- identifies --.
Line 15, insert -- the general -- after "within".

Column 6,
Line 8, insert -- identifies -- after "first byte".
Line 10, insert -- the general -- after "within".

Signed and Sealed this

Sixth Day of April, 2004

JON W. DUDAS
*Acting Director of the United States Patent and Trademark Office*